US011272730B2

(12) United States Patent
Migale

(10) Patent No.: US 11,272,730 B2
(45) Date of Patent: Mar. 15, 2022

(54) CONTAINER FOR SMOKING ACCESSORIES

(71) Applicant: Dante McDonough Migale, Novato, CA (US)

(72) Inventor: Dante McDonough Migale, Novato, CA (US)

(73) Assignee: Danté McDonough Migale, Novato, CA (US)

( * ) Notice: Subject to any disclaimer, the term of this patent is extended or adjusted under 35 U.S.C. 154(b) by 29 days.

(21) Appl. No.: 16/916,052

(22) Filed: Jun. 29, 2020

(65) Prior Publication Data

US 2020/0390145 A1 Dec. 17, 2020

Related U.S. Application Data

(63) Continuation-in-part of application No. 15/909,358, filed on Apr. 3, 2018, now abandoned.

(51) Int. Cl.
*A24C 5/44* (2006.01)
*A24F 23/00* (2006.01)

(52) U.S. Cl.
CPC ..... *A24C 5/44* (2013.01); *A24F 23/00* (2013.01)

(58) Field of Classification Search
CPC ..... A24F 9/12; A24F 9/14; A24F 9/16; A24F 15/18; A24F 15/20; A24F 23/00; A24C 5/40; A24C 5/42; A24C 5/44; A24C 5/46; A24C 5/425; A24C 5/465
USPC ..... 131/27.1, 47–53; 206/256
See application file for complete search history.

(56) References Cited

U.S. PATENT DOCUMENTS 229,076 A * 6/1880 Baker ..... A24C 5/44 131/47
367,036 A * 7/1887 Gardiner ..... A24C 5/44 131/58
723,863 A * 3/1903 Hamper ..... A24C 5/42 131/75
1,316,830 A * 9/1919 Chalmers ..... A24C 5/44 131/47
1,477,370 A * 12/1923 Laczko ..... A24C 5/44 131/48
1,724,735 A * 8/1929 Selbach ..... A24C 5/42 131/73
1,981,137 A * 11/1934 Earlw ..... A24C 5/44 131/47
2,317,513 A * 4/1943 Robert ..... A24C 5/44 131/47
2,352,999 A * 7/1944 Alland ..... A24C 5/44 131/47
2,740,443 A * 4/1956 Brown ..... A24C 5/44 83/425.3
2,843,134 A * 7/1958 Bass ..... A24F 15/18 131/235.1
5,927,488 A * 7/1999 Gray ..... A24F 23/04 206/237

(Continued)

FOREIGN PATENT DOCUMENTS

GB 191517273 A * 12/1916 ..... A24C 5/44

*Primary Examiner* — Joshua E Rodden

(57) ABSTRACT

A smoking accessory container is disclosed. The storage area of the smoking accessory container is configurable using one or more compartments. Accessory securing mechanisms may be implemented in the storage area of the smoking accessory container. A framework of a cigarette rolling device may be implemented on the outer surface of the smoking accessory container.

24 Claims, 9 Drawing Sheets

(56) References Cited

U.S. PATENT DOCUMENTS

| | | | | |
|---|---|---|---|---|
| 7,401,482 | B1 * | 7/2008 | Shaw | A45C 1/12 109/45 |
| 7,717,259 | B2 * | 5/2010 | Hatton | A24F 15/18 206/236 |
| 2016/0081390 | A1 * | 3/2016 | Ackerman | A24C 5/40 206/86 |

* cited by examiner

CONTAINER FOR SMOKING ACCESSORIES

CROSS REFERENCE TO RELATED APPLICATIONS

This application is a continuation in part of U.S. patent application Ser. No. 15/909,358, filed on Mar. 1, 2018.

FIELD

Embodiments of the invention relate generally to the field of accessories for smoking, and more specifically to smoking kits including related tools and containers for such items as cigarette rolling devices and rolling papers, smoking material such as tobacco, filters, filter tips, matches, lighters, and related items.

BACKGROUND

Various products and devices are generally used for smoking tobacco or other plants or suitable smoking material. Typically, smokers carry these items with them in their pockets or purses or in other containers. These items include, but are not limited to, the smoking material (e.g. tobacco), filters, filter tips, matches, and lighters. If these items are not kept together in a separate container they are apt to get lost or damaged.

Conventional implementations of smoking accessory containers are typically small boxes or cylindrical containers with lids or caps. Users would prefer the container to be as small as possible while still able to contain the smoking accessories they desire. Conventional implementations have several disadvantages in that they cannot contain all the accessories that some smokers would prefer and still be as small as desired. Also, the smoking accessories may be displaced within the container due to movement and may be damaged or contaminated by contact with the container or other accessories. Moreover, small items, such as filter tips or clip holders, are difficult to retrieve from such typical containers. For example, to retrieve a small item such as a filter tip from the bottom of the container, a user may have to empty the contents of the container.

One of the accessories that many smokers would like to have available is a cigarette rolling device. Typical cigarette rolling devices are relatively large compared to other accessories and due to their shape take up much of the space in a small smoking accessory container. Also, as with other accessories, performance is often sacrificed to achieve a smaller form factor.

There are many designs for cigarette rolling devices, but such devices typically include a frame component into which rolling pins are inserted with a rolling belt looped around the rolling pins such that slack in the rolling belt forms a recess between the rolling pins into which the smoking material is inserted. Typical devices can be disassembled into their component parts of framework, rolling pins, and rolling belt, and reassembled for use. However, even the disassembled components of a typical cigarette rolling device will require an inordinate amount of the storage space of a small smoking accessory container. Moreover, the typical cigarette rolling device is difficult to disassemble and reassemble.

These and other disadvantages of conventional smoking accessory containers may be addressed by the features, components, and concepts described herein.

BRIEF DESCRIPTION OF THE DRAWINGS

The following detailed description of embodiments of the invention, is better understood when read in conjunction with the appended drawings. For the purpose of illustrating the invention, there is shown in the drawings exemplary constructions of the invention; however, the invention is not limited to the specific features disclosed. In the drawings.

DETAILED DESCRIPTION

Embodiments of the invention provide a smoking accessory container that addresses disadvantages of conventional smoking accessory containers. For one embodiment, a smoking accessory container has compartments to create sections within the container for specific accessories which allows the user to easily locate a specific accessory within the container. For one such embodiment the compartments are removable and reconfigurable. The compartments allow a user to easily locate and access items within the container and to replace the items after use. For one embodiment, accessory securing mechanisms are implemented to secure accessories in a particular location within the container. Such securing features help to prevent the smoking accessories from moving within the container allowing the user easier access to the accessories when the container is opened. For one embodiment of the invention, a framework of a cigarette rolling device is implemented on an outer surface of a smoking accessory container. For one such embodiment, the rolling pins 604*a* and 604*b* and rolling belt 602 of the cigarette rolling device may be stored in the smoking accessory container. For one embodiment of the invention, a framework of a cigarette rolling device is implemented on the outer surface of the smoking accessory container such that the frame components are extendable for use and collapsible when not in use. For one such embodiment, a surface of the smoking accessory container functions as a further component of the framework of the cigarette rolling device. Such embodiments allow a cigarette rolling device to be easily assembled and disassembled and stored using less container space. Embodiments of the invention may have some or all of these features and may be implemented in various ways as described below.

Reference throughout the specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout the specification are not necessarily all referring to the same embodiment. Furthermore, the particular features, components, structures, or characteristics may be combined in any suitable manner in one or more embodiments.

Moreover, inventive aspects lie in less than all features of a single disclosed embodiment. Thus, any claims following the Detailed Description are hereby expressly incorporated into this Detailed Description, with each claim standing on its own as a separate embodiment of this invention.

Embodiments of the invention are applicable in a variety of applications in which smoking accessories are used and stored. Such applications include, but are not limited to, personal-size smoking accessory containers.

Exemplary Embodiments

Figure 1:
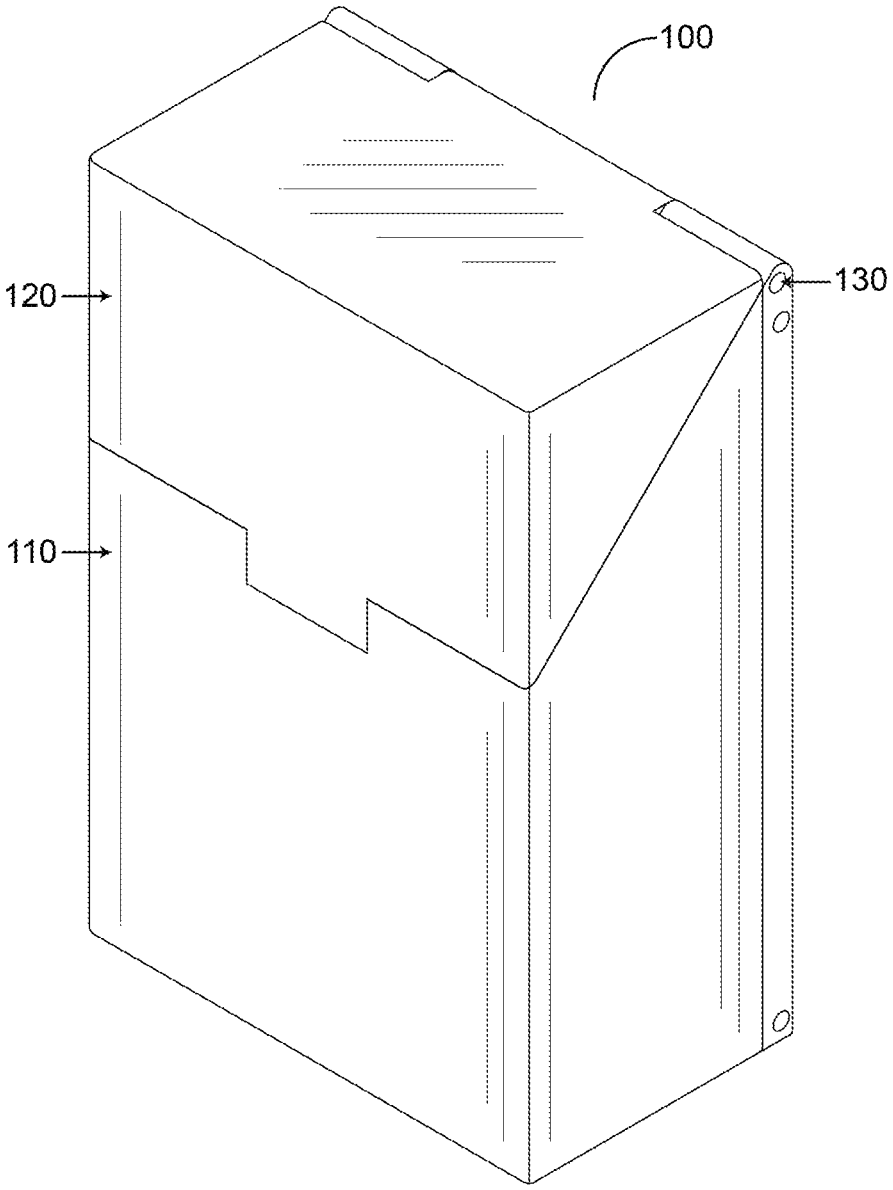
FIG. 1 illustrates a smoking accessory container in accordance with one embodiment of the invention.

FIG. 1 illustrates a smoking accessory container in accordance with one embodiment of the invention. Container 100, shown in FIG. 1, may be constructed from any suitable material for constructing small containers such as aluminum or plastic. Container 100 includes a storage portion 110 and a lid portion 120. For one embodiment of the invention, the lid portion 120 is connected to the storage portion 110 by hinge mechanism 130. Hinge mechanism 130 may be implemented as a separate rotating hinge or as a perforated portion of the material of container 100. In various alternative embodiments, the lid portion 120 may be separable from the storage portion 110 and may be secured to the storage portion in various ways, for example a snap-on lid.

Figure 2:
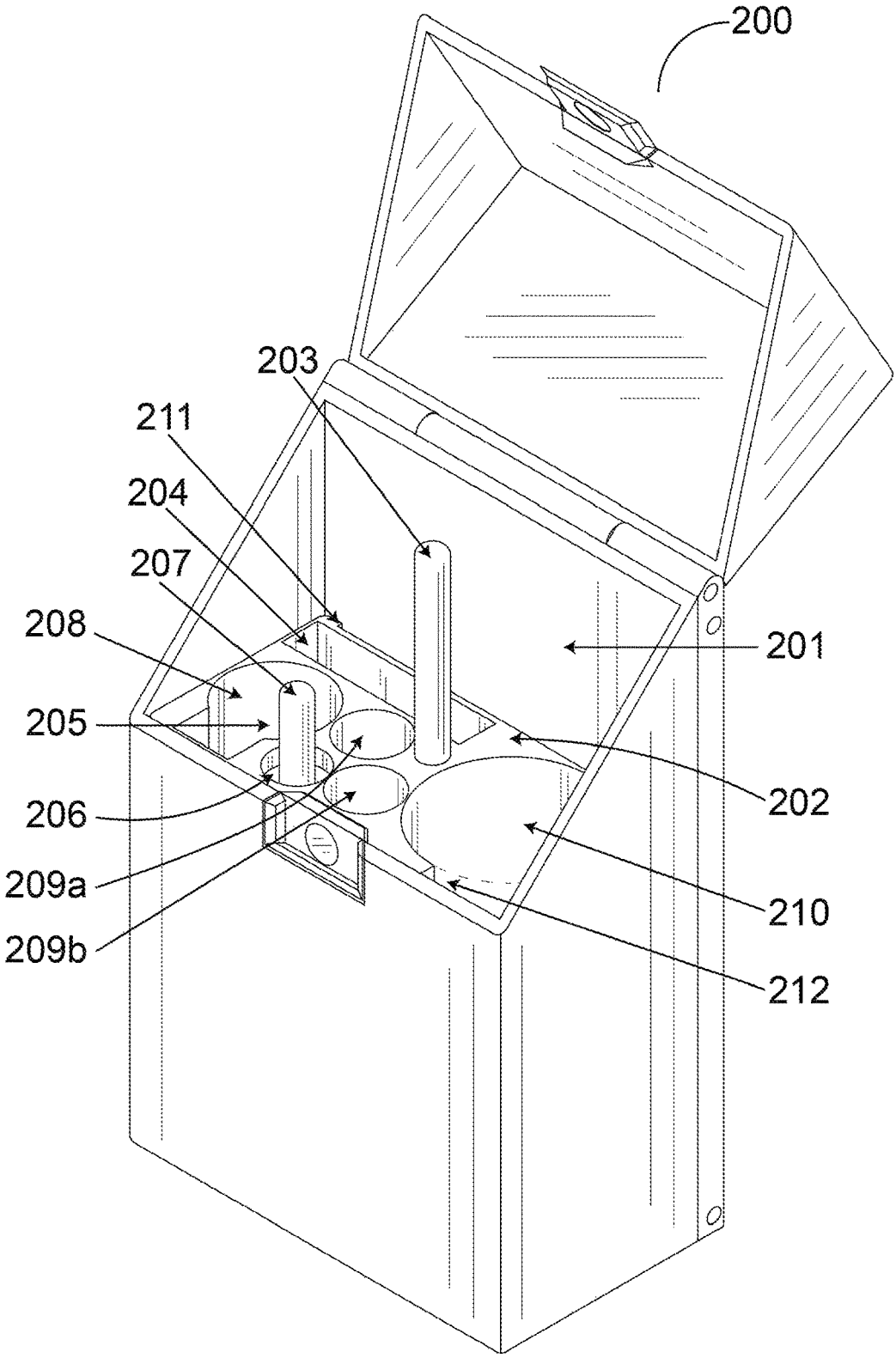
FIG. 2 illustrates a smoking accessory container in an open position showing the storage area with compartments and an accessory securing mechanism in accordance with one embodiment of the invention.

FIG. 2 illustrates a smoking accessory container in an open position showing the storage area with compartments and an accessory securing mechanism in accordance with one embodiment of the invention. Smoking accessory container 200 includes a storage area 201 for storing smoking accessories. Component 202 divides the storage area 201 into multiple compartments, shown for example as compartments 204, 208, 209*a*, 209*b*, 210, 211 and 212. A post 203 may be implemented to make the insertion and removal of the component 202 easier. The ability to divide the storage area allows the users to customize the storage area 201 for the specific accessories to be stored. The compartments, which may be easily inserted or removed from the smoking accessory container via a post 203, allow a user to reconfigure the storage area as desired. For example, a user may desire different storage area configurations depending on the particular accessories that the user desires to store at a particular time. Different storage compartments and configurations may exist to cater to the need of each individual user. Additionally, each storage compartment may itself be removable and configurable to allow for an even more personalized accessory container.

In accordance with one embodiment, compartments may be used to create a storage area having dimensions to accommodate specific accessories. For example, a compartment 211 may be used to create a storage area with dimensions to accommodate a card grinder which may have dimensions of approximately 85 mm×54 mm×1.5 mm, or, for example, a compartment 208 may be used to create a storage area to accommodate a disposable lighter which may have dimensions of approximately 66 mm×20 mm×15 mm. A compartment 204 may be used to create a storage area with dimensions to accommodate rolling papers which may have dimensions of approximately 78 mm×28 mm×6 mm. A compartment 210 may be used to create a storage area with dimensions to accommodate a cylindrical storage container that may hold smoking material which may have dimensions of approximately 84.5 mm×24.5 mm×24.5 mm. Compartment 212 may be used as a storage area that can accommodate the rolling belt 602. Compartments 209*a* and 209*b* may be used to create storage areas with dimensions to accommodate rolling pins 604*a* and 604*b* (see FIG. 6) which may have dimensions of approximately 84.5 mm×9 mm×9 mm. The specifically sized storage areas may help prevent the accessories from becoming displaced within the storage area and may help the user to conveniently locate the accessory within the storage area when needed and to replace the accessory after use. The specifically sized storage areas may help to prevent damage due to the accessories contacting one another within the storage area. For example, some accessories may be made of a delicate material such as glass while others may be made of metal, hardened plastic, or stone, and therefore, it may be beneficial to prevent the accessories from contacting one another or shifting suddenly within the container storage area by using compartments to provide specifically sized storage areas. Such storage areas also help to reduce noise when transporting the container.

As noted above, when using prior art containers, some accessories, particularly small accessories such as smoking tips and clips may fall to the bottom of the storage area making it difficult to retrieve them without emptying the container. Moreover, some accessories may be buffeted within the storage area. Further, since some smoking accessories may contact a user's skin or mouth when in use, it may be beneficial to help prevent such accessories from becoming contaminated by other accessories or items stored in the smoking accessory container.

In accordance with various embodiments of the invention, one or more accessory securing mechanisms, shown for example as accessory securing mechanism 205 of FIG. 2, may be implemented within the smoking accessory container 200. For various embodiments, accessory securing mechanisms may be connected to, and implemented with, the compartments discussed above. Accessory securing mechanisms may be implemented in various ways and the implementations may be specific to a particular type of smoking accessory. For example, as shown in FIG. 2, accessory securing mechanism 205 is implemented as a base 206 with a post 207 extending from the top surface. The base 206 may be square or rectangular to facilitate the insertion of the base into the storage area of the smoking accessory container 200, as a separate portion or integrated with the rest of the compartments. The post 207 extending from the base may be cylindrical to facilitate the retention of a particular type of smoking accessory. Accessory securing mechanism 205 may be used to secure a smoking tip within the storage area. In use the smoking tip is placed over the accessory securing mechanism 205 so that the post 207 is inserted into the smoking tip securing the smoking tip on the base 206.

The base and post configuration of accessory securing mechanism 205 is configured to hold a smoking tip in place so it is easily accessible to the user upon opening the smoking accessory container 200. When secured, for example by accessory securing mechanism 205, a smoking tip is less likely to be damaged by buffeting and less likely to be subjected to possible contamination within the storage area.

Accessory securing mechanisms may be implemented in various ways and may be specifically designed to secure a particular accessory. Such implementations may include hooks, Velcro® fasteners, snaps, or other known mechanisms used to secure an item.

Figure 3:
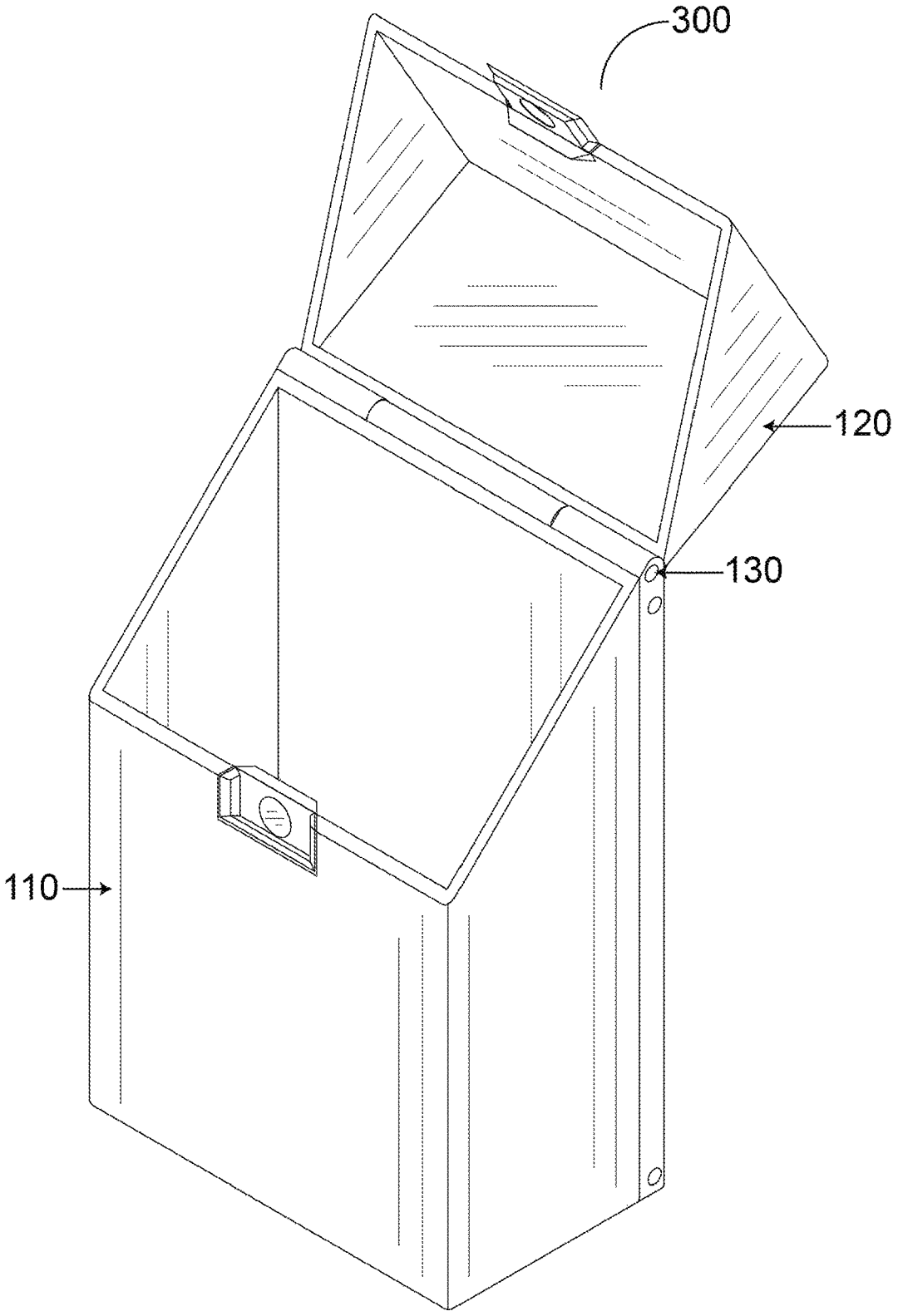
FIG. 3 illustrates a smoking accessory container in an open position showing the storage area without the compartments in accordance with one embodiment of the invention.

FIG. 3 illustrates a smoking accessory container in an open position showing the storage area without compartments or accessory securing mechanisms in accordance with one embodiment of the invention. Smoking accessory container 300, shown in FIG. 3 illustrates the convenience of providing a customizable storage area. As discussed above, in reference to FIG. 2, the compartments and accessory securing mechanisms may be removable. The removal of some or all of the compartments and accessory securing mechanisms may provide greater total storage area as desired by the user or may provide greater contiguous storage area for storing larger specific smoking accessories as desired by the user.

Figure 4A:
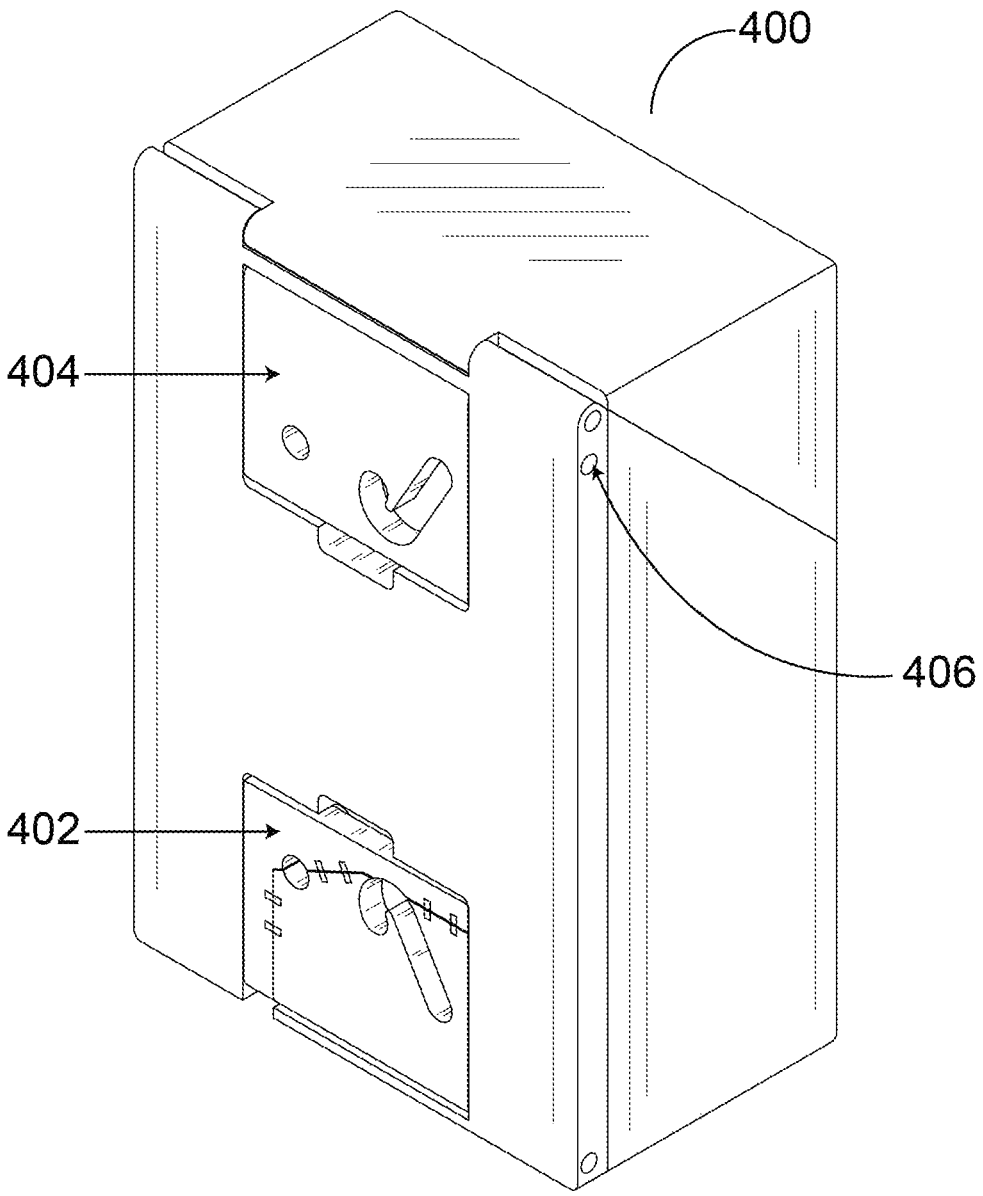
FIG. 4*a* and FIG. 4*b* illustrate frame components of a cigarette rolling device implemented on an outer surface of a smoking accessory container in accordance with one embodiment of the invention; and FIG. 5*a* and FIG. 5*b* illustrates a frame component of a cigarette rolling device in accordance with one embodiment of the invention.
Figure 4B:
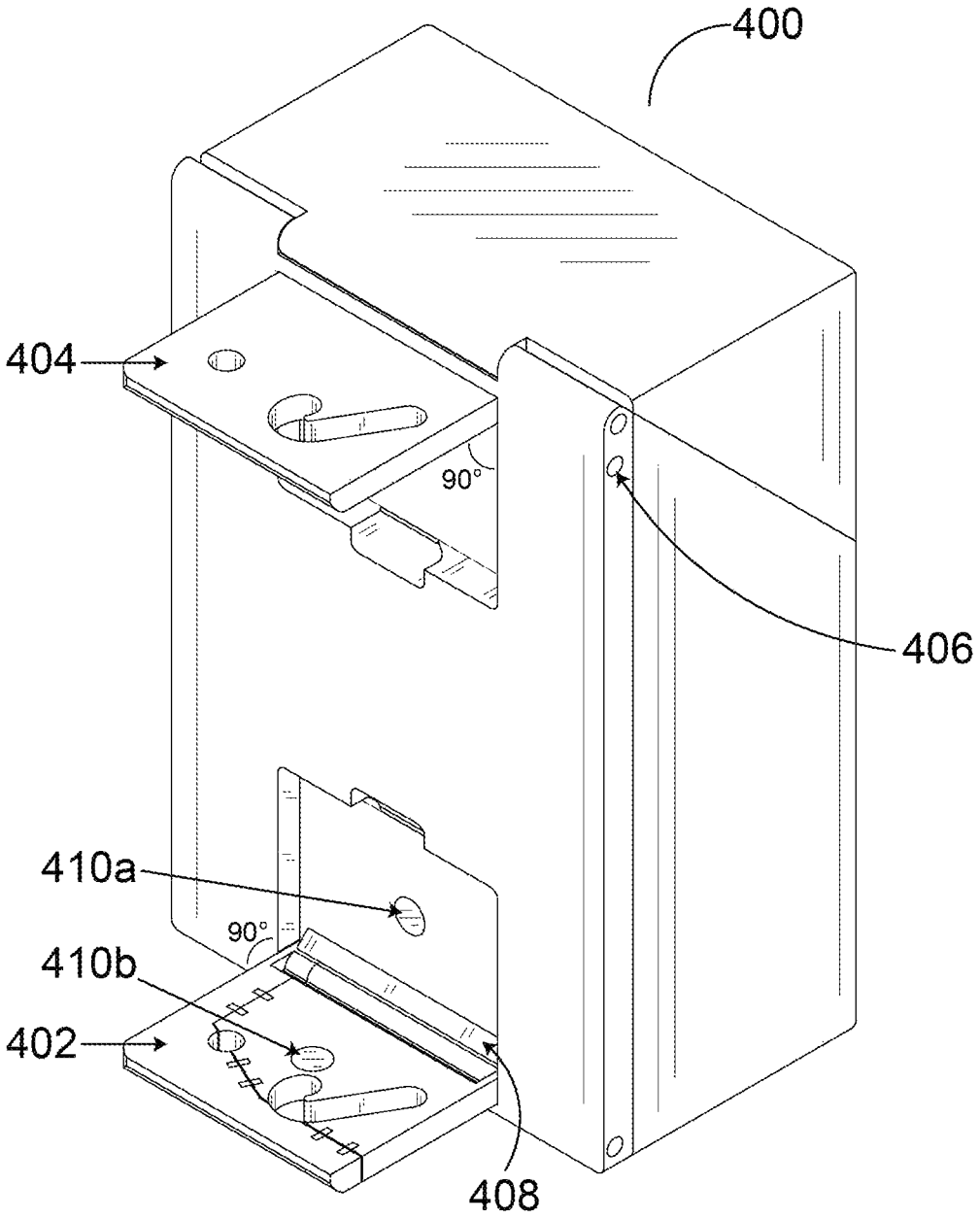

Embodiments of the invention provide a framework of a cigarette rolling device implemented on the outer surface of a smoking accessory container in a variety of ways in accordance with various embodiments of the invention. FIG. 4*a* and FIG. 4*b* illustrate frame components of a cigarette rolling device implemented on an outer surface of a smoking accessory container in accordance with one embodiment of the invention. As shown in FIG. 4*a*, smoking accessory container 400 has a framework of a cigarette rolling device, shown for example as frame components 402 and 404, implemented on the outer surface. Frame components 402 and 404 are flat against the container when not in use and can be extended during use to provide a framework of a cigarette rolling device, as shown in FIG. 4*b*. The frame components can be attached to the surface of the container in a variety of ways. For one embodiment, the frame components are attached to the surface of the container using a hinge mechanism, shown for example in FIG. 4*a*, as hinge mechanism 406, which connects frame component 404 to the surface of smoking accessory container 400. A corresponding hinge mechanism, connects frame component 402 to the surface of smoking accessory container 400. When not in use, the frame components 402 and 404 can be held in place using magnets 410*a* and 410*b*, as shown in FIG. 4*b*, implemented in the surface of the container and the inner surface of the frame components 402 and 404. In another embodiment of the invention the frame components may snap into place, or may be latched, or held in place using other known methods for securing a component in a particular position when not in use, such as snaps, clips, or Velcro®.

As shown in FIG. 4*b*, the frame components 402 and 404 may be extended for use. During use, the frame components are extended to approximately 90° as shown. For one embodiment, one or more lips 408 may be formed on the surface of the container adjacent to the hinge mechanisms used to connect the frame components to the surface of the container. The lips 408 help prevent the frame components from extending beyond approximately 90°. For example, as shown in FIG. 4*b*, lip 408 prevents frame component 402 from extending beyond approximately 90°. A corresponding lip 408, not shown, prevents frame component 404 from extending beyond approximately 90°.

During use, additional components of a cigarette rolling device are used in conjunction with the frame components implemented on the surface of the container. For example, a typical cigarette rolling device may include one or more rolling pins, for example, 604*a* and 604*b*, and a rolling belt 602 in addition to the frame components (see FIG. 6). The frame components implemented on the surface of the smoking accessory container may be used in conjunction with these additional components to implement a cigarette rolling device. After use, the cigarette rolling device may be disassembled and the additional components (e.g., rolling pins 604*a* and 604*b* and rolling belt 602) may be stored in the smoking accessory container. Preferably, the cigarette rolling device will include one or two rolling pins and, more preferably, two rolling pins.

Figure 5A:
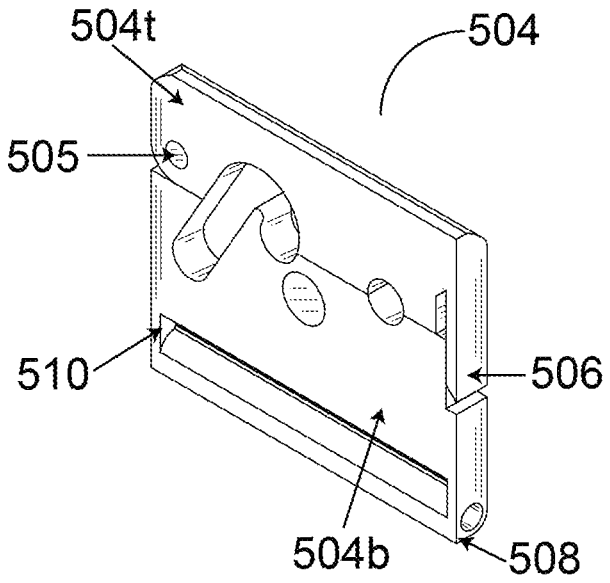
Figure 5B:
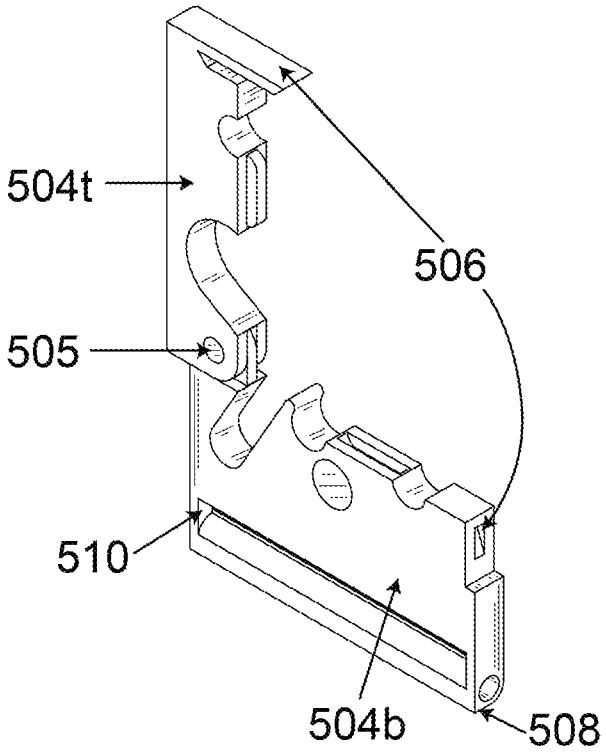

FIG. 5*a* illustrates a frame component of a cigarette rolling device in a closed position in accordance with one embodiment of the invention and FIG. 5*b* illustrates a frame component of a cigarette rolling device in an opened position in accordance with one embodiment of the invention. For one embodiment of the invention, at least one of the frame components may open to allow insertion of the rolling pins 604*a* and 604*b* and rolling belt 602. For example, for one embodiment of the invention, the frame components may not extend beyond ninety degrees. For such an embodiment, at least one of the frame components is implemented as two pieces connected by a hinge mechanism that allows the frame component to open for insertion of the rolling pins 604*a* and 604*b* and rolling belt 602. As shown in FIG. 5*a*, frame component 504 is comprised of top frame component portion 504*t* and a bottom frame component portion 504*b* that are connected by hinge mechanism 505. As shown in FIG. 5*a*, the frame component portions 504*b* and 504*t* are in a closed position and are held in the closed position by snap mechanism 506.

As shown in FIG. 5*b*, the frame component portions 504*b* and 504*t* are in an open position to allow insertion of the rolling pins 604*a* and 604*b* and rolling belt 602. After, the rolling pins 604*a* and 604*b* and rolling belt 602 are inserted, the frame component portions 504*b* and 504*t* may be snapped together using snap mechanism 506. This snap mechanism may be magnets, a clip, a latch, a slider, snaps, or Velcro®. After use, the frame component portions 504*b* and 504*t* may be placed in an open position to remove the rolling pins 604*a* and 604*b* and rolling belt 602.

A lip 508 may be present, which may correspond to lip 408, to help prevent frame component 402 (see FIG. 4*b*) from extending beyond approximately 90°. A similar lip, not shown, may also be present on frame component 404 (see FIG. 4*b*) to help frame prevent component 404 (see FIG. 4*b*) from extending beyond approximately 90°. An indentation 510 may exist on the underside of frame components 402 and 404 (see FIG. 4*b*) to accommodate lips 408 (see FIG. 4*b*) if present so that the frame components 402 and 404 (see FIG. 4*a*) may be flush with the outer surface of the smoking accessory container when not in use.

As noted above, the two-piece frame component implementation as described in reference to FIG. 5*a* and FIG. 5*b*, is one of many ways of implementing a frame component of a cigarette rolling device on the surface of a smoking accessory container.

For one alternative embodiment, a spring is implemented between the surface of the container and each of the frame components 402 and 404. The force of the spring keeps each frame component in a closed position. The user may pull the frame components 402 and 404 open past a ninety degree angle to slip the rolling pins into place. At this point, the user may release the frame components 402 and 404, which will be pulled into the rolling pins 604*a* and 604*b* due to the spring, and the rolling pins 604*a* and 604*b* will keep the frame components from closing.

In one embodiment of the present invention, the smoking accessory container will contain one or more lips on the body of the container that prevent at least one of the frame components that secure the rolling pins from extending beyond a ninety degree angle. For example, one frame component may utilize the hinge mechanism, while the other frame component utilizes the spring mechanism, to secure the frame components to the outer surface of the smoking accessory container. Alternatively, in another embodiment of the invention, the one or more lips on the body of the container prevent both of the frame components that secure the rolling pins from extending beyond a ninety degree angle. In this example, both frame components are secured to the body of the container via the hinge mechanism.

Figure 6:
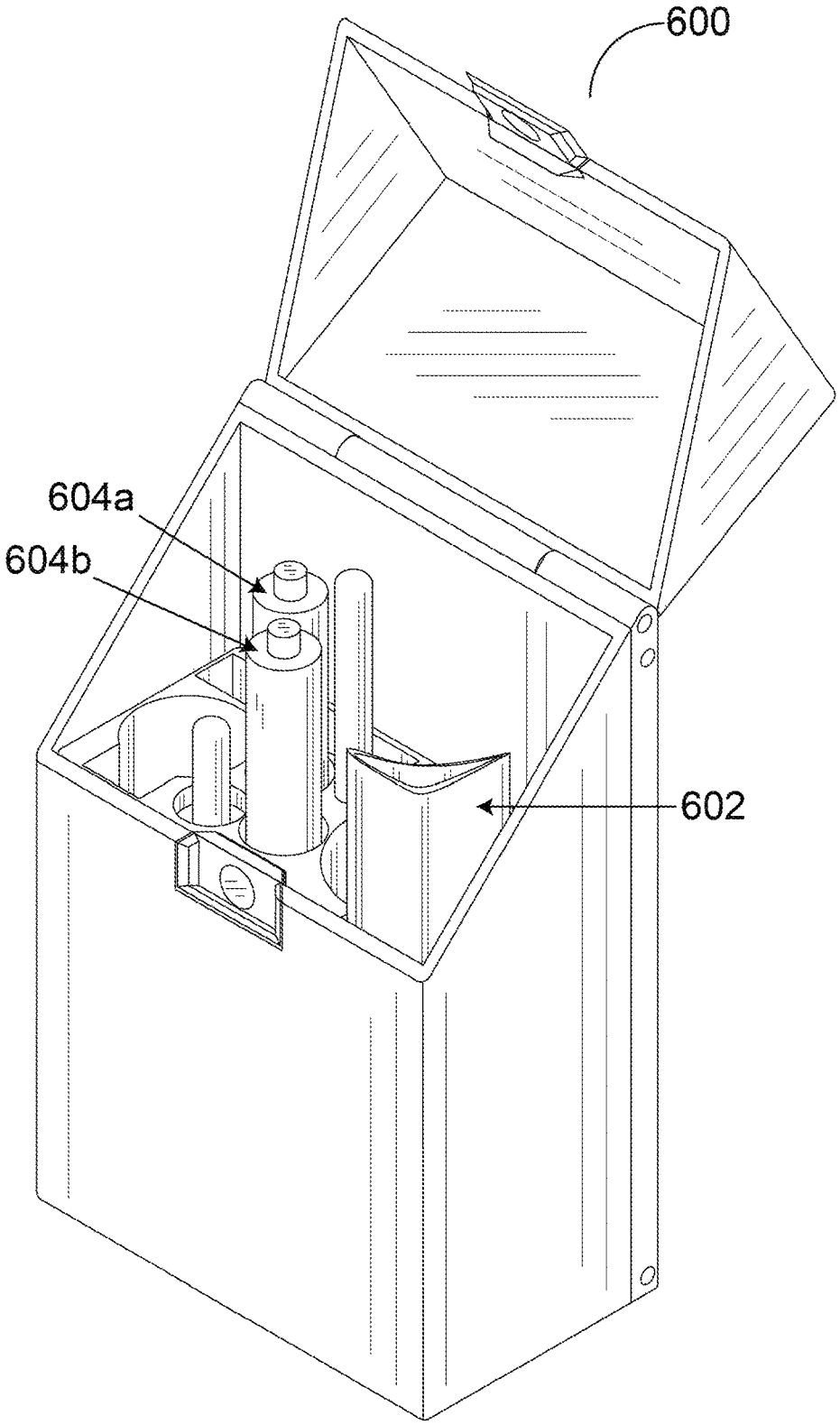
FIG. 6 illustrates the rolling pins and rolling belt in their appropriate storage compartments in accordance with one embodiment of the invention.

FIG. 6 illustrates the rolling pins 604*a* and 604*b* and the rolling belt 602 in their respective storage compartments within the smoking accessory container 600. When not in use, the rolling pins 604*a* and 604*b* and rolling belt 602 can be stored inside of the container to save space for transportation, for protection, and to make the rolling pins 604*a* and 604*b* and rolling belt 602 easier to locate and retrieve. Said compartments safely secure components like the rolling pins 604*a* and 604*b* and rolling belt 602 so that they do not make noise or potentially break during transportation.

Figure 7:
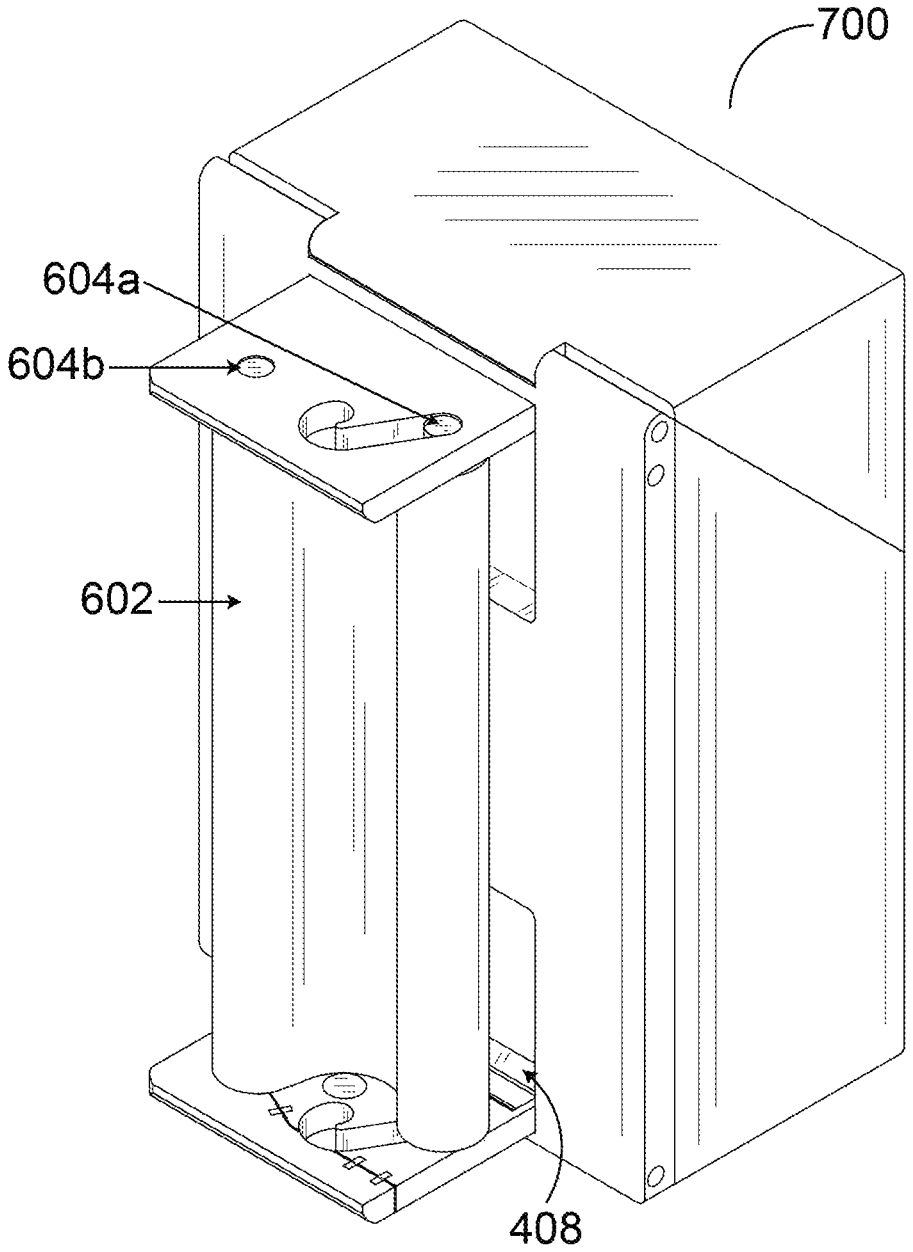
FIG. 7 illustrates an assembled cigarette rolling device in accordance with one embodiment of the invention.

FIG. 7 illustrates the rolling mechanism fully assembled for use. As seen on smoking accessory container 700, the frame components 402 and 404 are extended up to a ninety degree angle and the rolling pins 604*a* and 604*b* are secured into the frame components 402 and 404 with the rolling belt 602 wrapped around the rolling pins 604*a* and 604*b*. The user may now deposit smoking material into a groove in the rolling belt 602 to begin the cigarette rolling process.

Figure 8A:
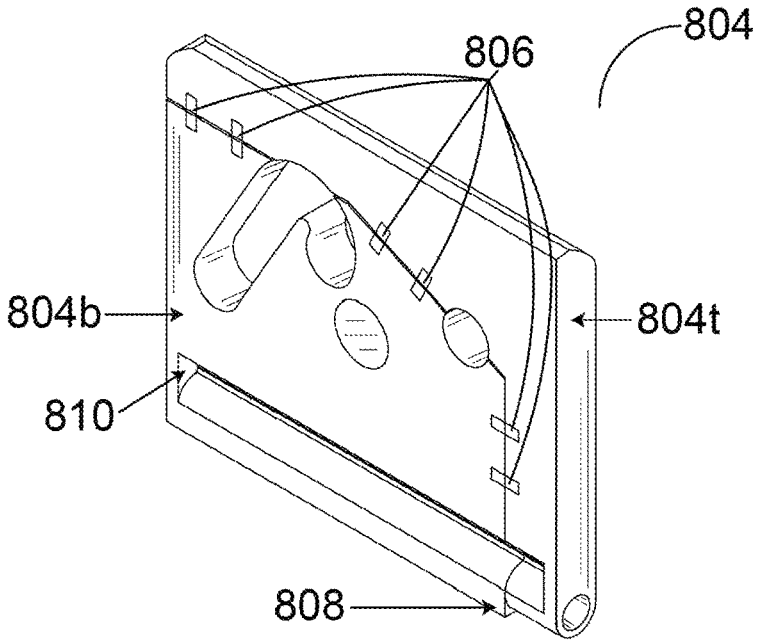
FIG. 8*a* and FIG. 8*b* illustrates a frame component of a cigarette rolling device in accordance with one embodiment of the invention.
Figure 8B:
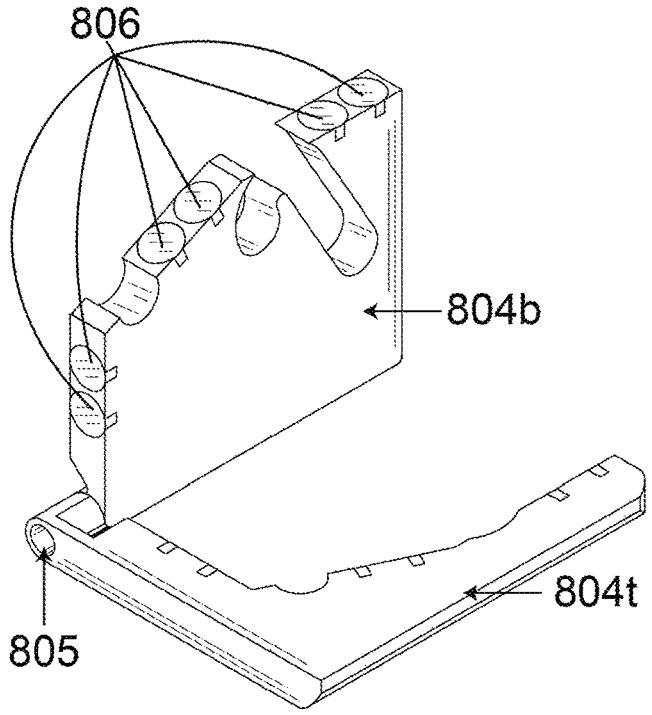

FIG. 8*a* illustrates a frame component of a cigarette rolling device in a closed position in accordance with one embodiment of the invention and FIG. 8*b* illustrates a frame component of a cigarette rolling device in an opened position in accordance with one embodiment of the invention. For one embodiment of the invention, at least one of the frame components may open to allow insertion of the rolling pins 604*a* and 604*b* and rolling belt 602. For example, for one embodiment of the invention, the frame components may not extend beyond ninety degrees. For such an embodiment, at least one of the frame components is implemented as two pieces connected by a hinge mechanism that allows the frame component to open for insertion of the rolling pins 604*a* and 604*b* and rolling belt 602. As shown in FIG. 8*a*, frame component 804 is comprised of top frame component portion 804*t* and a bottom frame component portion 804*b* that are connected by hinge mechanism 805. As shown in FIG. 8*a*, the frame component portions 804*b* and 804*t* are in a closed position and are held in the closed position by magnets 806.

As shown in FIG. 8*b*, the frame component portions 804*b* and 804*t* are in an open position to allow insertion of the rolling pins 604*a* and 604*b* and rolling belt 602. After, the rolling pins 604*a* and 604*b* and rolling belt 602 are inserted, the frame component portions 804*b* and 804*t* may be secured together using magnets 806. After use, the frame component portions 804*b* and 804*t* may be placed in an open position to remove the rolling pins 604*a* and 604*b* and rolling belt 602.

A lip 808 may exist to correspond to lip 408 (see FIG. 4*b*) to help keep frame component portion 804*b* from extending beyond approximately 90°. Frame component portion 804*t* may lack a lip to allow frame component portion 804*t* to extend beyond a ninety degree angle, while frame component 804*b* is limited to a more upright position. An indentation 810 may exist on the underside of frame components 402 and 404 (see FIG. 4*b*) to accommodate lips 408 (see FIG. 4*b*) if present so that the frame components 402 and 404 (see FIG. 4*a*) may be flush with the outer surface of the smoking accessory container when not in use.

A smoking accessories container in accordance with various alternative embodiments of the invention, may be made of a light metal such as aluminum, or may be made of plastic, wood, or any suitable material. As noted above, one or more compartments may be used to create accessory-specific storage areas. Compartments may also be used to create storage areas to accommodate accessories of a specific type and manufacturer (e.g., a Bic® disposable lighter). In accordance with one embodiment of the invention, the compartments can be removed individually and repositioned to create storage space configurations as desired by the user.

In accordance with various alternative embodiments of the invention, one or more accessory securing mechanisms may be implemented within the storage area of the smoking accessory container. The accessory securing mechanisms may be implemented in various ways as discussed above and may be attached to the inner surface of the smoking accessory container or may be attached to the compartments inserted into the smoking accessory container. In accordance with one embodiment of the invention, the accessory securing mechanisms, can be removed and repositioned as desired by the user. As discussed above, alternative embodiments of the invention may provide accessory securing mechanisms for specific types of accessories and configured for a particular accessory. Such accessory-specific securing mechanisms may provide easier access to the accessory and may help to prevent the accessory from being damaged or contaminated.

As discussed above there are many ways to implement a framework of a cigarette rolling device on the outer surface of a smoking accessory container. Such embodiments are efficient because the cigarette rolling device can be disassembled and its components stored separately. Further, the surface of the container acts as a portion of the framework of the cigarette rolling device. Moreover, the frame components of the cigarette rolling device may be retracted when not in use.

While the invention has been described in terms of several embodiments, those skilled in the art will recognize that the invention is not limited to the embodiments described but can be practiced with modification and alteration within the spirit and scope of the appended claims. The description is thus to be regarded as illustrative instead of limiting.

What is claimed is:

1. A smoking accessory container comprising:

a body;

a lid: the body and the lid formed from a rigid material and defining a storage area, the smoking accessory container having an inner surface and an outer surface;

a framework of a cigarette rolling device implemented on the outer surface of the smoking accessory container;

one or more rolling pins; and a rolling belt;

wherein the framework comprises two separate components independently attached to the outer surface smoking accessory container and which are capable of securing the one or more rolling pins;

wherein at least one of the framework components of the cigarette rolling device that secure the one or more rolling pins is implemented as two pieces;

wherein the two nieces that form at least one of the framework components are movable in regards to one another.

2. The smoking accessory container of claim 1, further comprising one or more compartments to divide the storage area in to multiple storage areas.

3. The smoking accessory container of claim 2, wherein one or more of the multiple storage areas have dimensions that accommodate a specific smoking accessory.

4. The smoking accessory container of claim 3, wherein one or more of the multiple storage areas have dimensions that accommodate the one or more rolling pins and the rolling belt.

5. The smoking accessory container of claim 1, having one or more accessory securing mechanisms implemented within the storage area.

6. The smoking accessory container of claim 5, wherein one of the one or more accessory securing mechanisms comprises a base and post for securing a filter tip.

7. The smoking accessory container of claim 1, wherein each of the two independently attached framework components of a cigarette rolling device is attached to the outer surface of the smoking accessory container using a hinge mechanism.

8. The smoking accessory container of claim 1, wherein the framework of a cigarette rolling device configured to be retracted and secured when not in use.

9. The smoking accessory container of claim 1, wherein each of the two independently attached framework components of a cigarette rolling device is secured via a magnet implemented in the outer surface of the smoking accessory container and/or the framework component.

10. The smoking accessory container of claim 1, further comprising one or more lips on the body of the container that prevents at least one of the framework components that secures the rolling pins from extending beyond a ninety degree angle.

11. The smoking accessory container of claim 10, wherein the one or more lips on the body of the container prevent both of the framework components that secure the rolling pins from extending beyond a ninety degree angle.

12. The smoking accessory container of claim 1, wherein the framework of a cigarette rolling device is secured via implementation of one or more springs.

13. The smoking accessory container of claim 1, wherein the container is secured via the use of magnets, a latch, a slider, one or more clips, or a lock and key implemented on the lid and/or the body of the container.

14. The smoking accessory container of claim 1, wherein the two piece framework component is secured by one of: magnets, a snap mechanism, a latch a slider, and Velcro®.

15. The smoking accessory container of claim 1, wherein the one or more rolling pins comprise one or two rolling pins.

16. The smoking accessory container of claim 1, wherein the one or more rolling pins comprise two rolling pins.

17. A smoking accessory container comprising:

a body;

a lid; the body and the lid formed from a rigid material and defining a storage area, the smoking accessory container having an inner surface and an outer surface;

a framework of a cigarette rolling device implemented on the outer surface of the smoking accessory container;

one or more rolling pins; and a rolling belt;

wherein the framework comprises two separate components independently attached to the outer surface smoking accessory container and which are capable of securing the one or more rolling pins;

wherein the framework of a cigarette rolling device is secured via implementation of one or more springs.

18. The smoking accessory container of claim 17, further comprising one or more compartments to divide the storage area in to multiple storage areas.

19. The smoking accessory container of claim 18, wherein one or more of the multiple storage areas have dimensions that accommodate a specific smoking accessory.

20. The smoking accessory container of claim 19, wherein one or more of the multiple storage areas have dimensions that accommodate the one or more rolling pins and the rolling belt.

21. The smoking accessory container of claim 17, having one or more accessory securing mechanisms implemented within the storage area.

22. The smoking accessory container of claim 17, wherein each of the two independently attached framework components of a cigarette rolling device is attached to the outer surface of the smoking accessory container using a hinge mechanism.

23. The smoking accessory container of claim 17, wherein the framework of a cigarette rolling device configured to be retracted and secured when not in use.

24. The smoking accessory container of claim 17, wherein the container is secured via the use of magnets, a latch, a slider, one or more clips, or a lock and key implemented on the lid and/or the body of the container.

* * * * *